US006058639A

United States Patent [19]

Tinklenberg et al.

[11] Patent Number: 6,058,639

[45] Date of Patent: May 9, 2000

[54] BLUNTLY POINTED TONGUE MARKING TAG

[75] Inventors: Lloyd Tinklenberg, Worthington, Minn.; John B. Linquist, Sibley, Iowa; Gary L. Lowe, Worthington, Minn.

[73] Assignee: Bedford Industries, Inc., Worthington, Minn.

[21] Appl. No.: 08/715,574

[22] Filed: Sep. 18, 1996

[51] Int. Cl.[7] ..... G09F 23/00

[52] U.S. Cl. ..... 40/665; 40/637

[58] Field of Search ..... 40/665, 662, 299, 40/63; 24/30.5 S, 567

[56] References Cited

U.S. PATENT DOCUMENTS

| | | | |
|---|---|---|---|
| D. 305,036 | 12/1989 | Voetsch | D19/34 |
| 819,504 | 5/1906 | Benedict . | |
| 1,005,894 | 10/1911 | Seneman | 40/662 |
| 1,345,713 | 6/1920 | Stevens . | |
| 2,248,145 | 8/1941 | Wilder | 40/299 X |
| 2,609,629 | 9/1952 | Hubbard | 40/1.5 |
| 2,669,047 | 2/1954 | Rieger | 40/637 |
| 2,717,572 | 9/1955 | Kingman . | |
| 3,348,272 | 10/1967 | Germani . | |
| 3,381,654 | 5/1968 | Hupp et al. | 116/119 |
| 4,020,575 | 5/1977 | Kruger et al. | 40/1.5 |
| 4,026,413 | 5/1977 | Britt et al. . | |
| 4,292,714 | 10/1981 | Walker . | |
| 4,914,789 | 4/1990 | Pedersen | 244/30.5 S |
| 5,231,735 | 8/1993 | Paxton . | |

FOREIGN PATENT DOCUMENTS

| | | |
|---|---|---|
| 539892 | 10/1959 | Belgium . |
| 360971 | 5/1962 | Switzerland . |

*Primary Examiner*—Cassandra H. Davis
*Attorney, Agent, or Firm*—R. C. Baker & Associates, Ltd.

[57] ABSTRACT

The marking tag for banded merchandise has a resilient flat sheet with printed matter on at least one surface and an outer perimeter defining the outer limits of the body. Entirely within the outer perimeter is a pair of openings in spaced relationship and a slit connecting the pair of openings and forming a resilient bluntly pointed tongue in the body. The tongue has opposing straight side portions in an angular relationship greater than 40 degrees and less than 80 degrees and the opposing sides converge toward each other and are conjoined at the bluntly pointed tip. The bluntly pointed tongue is easily temporarily deflected from the plane of the body by finger pressure to readily insert the tip underneath a band about banded merchandise and slide the tongue fully under the band to seat the band in the pair of openings. The tag is thus placed in a substantially flush condition against the banded merchandise.

12 Claims, 1 Drawing Sheet

BLUNTLY POINTED TONGUE MARKING TAG

BACKGROUND OF THE INVENTION

This invention relates to a bluntly pointed tongue marking tag for banded merchandise, to a composite of banded merchandise with the bluntly pointed tongue marker affixed thereto, and to a method for affixing the new bluntly pointed tongue marking tag to banded merchandise.

The banding of merchandise into clumps of the size desired by consumers is well known and widely practiced. The band may consist of rubber or twist tie or string and may be about one or more boxes or about clumps of merchandise or about rolled or folded merchandise such as a newspaper. A particularly popular and well-known practice is that of banding clumps of agricultural produce for easy handling in supply channels and attractive display to consumers.

The marking of banded clumps with the necessary information for inventory control and accuracy of processing by scanning (as at supermarket check-out counters), as well as for attractiveness of display for the consumer, has received an enormous amount of attention and has led to the development of marking tags having varied styles of hooks and varied slits and holes or openings or orifices for receiving the band material. The known varied styles of tags having hooks, however, are associated with a single orifice and cause a tag on the banded merchandise to be in an angular relationship with respect to the band. Known dual-orifice or dual-hole or dual-opening marking tags for affixing to a band about merchandise without causing an angular position for the tag with respect to the band have suffered from the problem of being difficult or tedious to affix to the band. They require the exercise of too much effort and skill and labor time to get properly fixed on the band. A still further known tag has been one that lacks holes or orifices and simply has a three-sided cut with all of the sides at right angles to each other. It is easily dislodged from the band about merchandise, which makes it unreliable as a marker.

The present invention solves the problem of quick tag affixation to the band about merchandise and does this in combination with maintaining at least one face of the tag in flush condition with the merchandise rather than projecting at an angle out from the band, thereby permitting scannability of the composite marked merchandise by simply grabbing the merchandise with one hand and moving it over a scanner instead of using two hands, one to grab the merchandise and the other to hold the tag while it is moved over the scanner at a check-out counter.

SUMMARY OF THE INVENTION

The new marking tag of this invention is formed out of a resilient flat sheet body having opposing surfaces at least one of which is for printed matter and having an outer perimeter defining the outer limits of the sheet body. The body itself is characterized by having several significant features all entirely within its outer perimeter.

First, it has a pair of openings extending through the body for receiving the band about merchandise. These openings are in spaced relationship, preferably with each equally spaced from a perimeter edge of the body. The openings (or orifices as they are sometimes called) preferably have edges that are of a rounded character; and circular as well as oval or elongated openings are desirable.

Another significant feature is the resilient bluntly pointed tongue formed in the flat sheet body by a slit connecting the pair of openings. The tongue has a base portion that is between the openings and a bluntly pointed tip portion that is spaced from each opening to a substantially equal extent. Additionally, the tongue has sides which include a straight portion of at least about a centimeter in length. The straight portions on the opposite sides of the tongue are in an angular relationship to each other. The angle is greater than 40 degrees and less than 80 degrees, such that the sides converge toward each other and are conjoined or united at the bluntly pointed tip of the tongue. Ideally, the sides of the tongue formed by the slit extend in a straight direction directly from their respective openings, although the slit forming the sides of the tongue may extend first laterally away from the openings (i.e., laterally out from the tongue base) and then curve to form converging straight sides for the tongue.

The bluntly pointed tongue extends from the pair of openings in a manner that permits the new marking tag to be fixed to a clump of merchandise in an extremely quick and simple manner. The tongue is easily deflected out of the plane of the sheet body of the tag by simply applying finger pressure to the tongue. The bluntly pointed apex or tip of the tapered tongue is then inserted between a band material and the merchandise about which the band is looped such that the tongue is easily slid beneath the band, which results in the band being advanced toward the pair of openings and ultimately being seated in the openings. Releasing finger pressure from the tongue permits it and the remaining body of the tag to return to a relaxed condition with the edges of the tongue resting against the remaining body of the tag from which the tongue was slit.

An article carrying the new marking tag on the band about the merchandise is not only attractive in appearance but possesses the advantageous feature of being easily scanned by a single hand grip on the merchandise instead of using two hands to scan a marking tag that is dangling in an angular relationship from a band about banded merchandise.

Still other benefits and advantages and features of the invention will be evident as this description proceeds.

DESCRIPTION OF THE PREFERRED EMBODIMENT(S)

Figure 1:
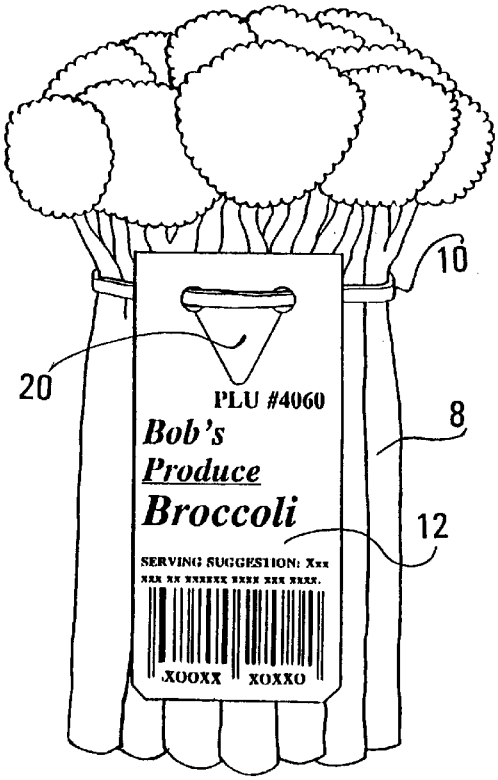
FIG. 1 is a front face view of the marking tag of the invention affixed on a band about a banded clump of merchandise (for example, an agricultural product called broccoli)
Figure 2:
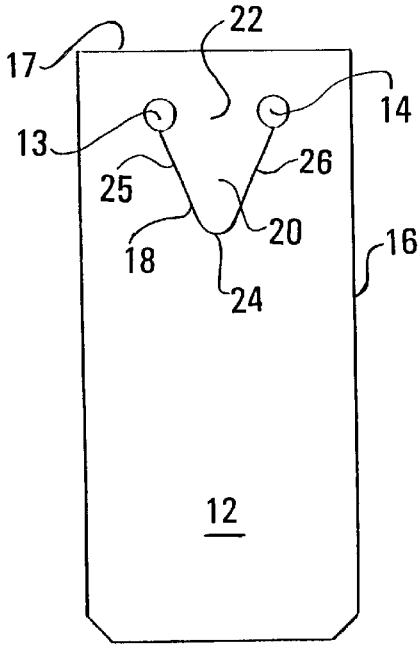
FIG. 2 is a schematic face view of the marking tag of the invention, free of any banded merchandise.

Referring to FIGS. 1 and 2, the clump of agricultural produce 8 is held together by a band, especially a rubber band 10, but optionally a twist tie band or other band of string-type material. The marking tag 12 of this invention is fixed on the clump with the band 10 extending through each of the openings or orifices 13, 14 of the tag such that the band passes over the base 22 of the tongue 20 (i.e., the base of the tongue lies between the band 10 and the clump 8). The tongue base is defined as the portion of the tag between the openings 13 and 14.

The body of the tag apart from the base 22 of the tongue 20 is on the outside of the band 10 (i.e., not between the band 10 and merchandise 8). The result is a substantially symmetrical arrangement whereby the tag 12 is held in substantially flush condition against the band of banded merchandise instead of dangling off at an angle from the band about the merchandise.

Generally the outer perimeter 16 for the sheet body of the tag will be somewhat rectangular (including possibly square) in shape, although the corners of the body may be rounded or angled to avoid sharp edges and for ease of commercial die manufacture.

In most instances, the paired holes or orifices or openings 13, 14 will be located in an equally spaced relationship to an edge, such as edge 17 of the outer perimeter. This particular edge 17 may be called the primary edge. While it preferably is straight, there is nothing critical about its being straight in practicing the invention. The edge may indeed be curved if desired. Other perimeters than rectangular for the body of the tag may be employed if desired. The perimeter may be oval or curved. The critical point is that no perimeter edge of the tag functions as a special access route for affixing the tag to banded material. The important features of the invention are all entirely within the outer perimeter of the main body 12 of the tag.

Figure 6:
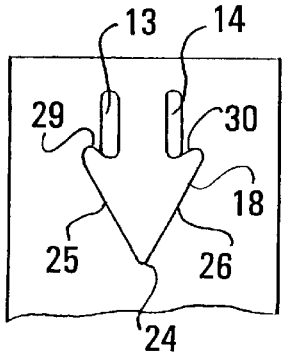
FIG. 6 is a schematic face view, partially broken away, illustrating a modified form for the new tag and particularly illustrating the contour for the cut line between the openings (i.e., illustrating a cut line that projects laterally away from the pair of openings before the cut line extends along straight portions that converge to form the bluntly pointed tip).

The pair of orifices or openings 13, 14 extend entirely through the body and are for receiving the band. Their spaced relationship to each other should be such that the di stance between the openings 13 and 14 should be approximately equal to the distance from each opening to the bluntly pointed tip 24 of the tongue 20. Here again, there is possibility for variation. The distance between openings 13 and 14 may be up to about 25 percent greater than the distance from an opening to the tip 24. Generally the direction of variation from the preferred is that of employing a slightly shorter distance (e.g., up to about half) for the spacing between the openings 13 and 14 as compared to the distance between an opening and the bluntly pointed tip 24 (e.g., see FIG. 6). The distance from each opening 13, 14 to the tip 24 should be equal or near equal, i.e., substantially equal.

The tongue 20 is formed by a single slit 18, which extends between the openings 13, 14 but extends in a direction away from each opening and forms the bluntly pointed tip 24 of the tongue. In short, the slit extends through the body and connects the pair of openings and forms the resilient bluntly pointed tongue of the flat sheet body. It is the opposing sides 25, 26 of the tongue and the bluntly pointed tip 24 that are defined by the slit. There is a straight portion of the slit extending for at least a centimeter in length along each opposing side of the tongue. This straight portion can be stated to equal at least half the distance from its connected opening to the tongue tip.

The straight portions 25 and 26 should be substantially equal and are in an angular relationship with respect to each other. The angular relationship is such that it is in excess of or greater than 40 degrees and is less than 80 degrees. Within this range is a preferred range between about 50 and 65 degrees. This angular relationship is critical for easy, quick affixation of the new marking tag on a band about banded merchandise. The angular relationship between the straight portions of the opposing sides of the tongue is such that the straight portion of the opposing sides 25 and 26 of the tongue converge toward each other and are conjoined at the bluntly pointed tip 24 of the tongue.

Illustrated in FIGS. 1, 2, 3, and 4 is the fact that the slit 18 preferably extends from an edge of each opening or orifice 13, 14 in a straight line toward the bluntly pointed tip 24. The edge of each orifice or opening from which the slit or cut line preferably extends is the edge opposite the outer perimeter 17 (i.e., opposite the perimeter edge from which the paired openings are substantially equally spaced).

One alternative for the slit 18 of continuous nature between the paired openings involves having a portion of the slit, as it is connected to or leaves a paired opening, extend laterally out from the opening (as at 29 and 30 in FIG. 6) and then curve to form a straight section 25, 26. The straight sections converge at the bluntly pointed apex or blunt tip 24 of the tongue.

Figure 3:
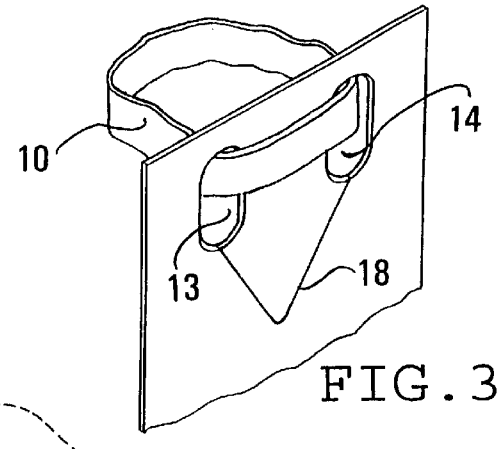
FIG. 3 is a schematic perspective view of the new tag, with much of the tag broken away, illustrating oblong spaced openings and a band extending between the openings.

FIG. 3 illustrates the oval or elongated type of opening or orifice with each orifice or opening of the pair extending in a more or less perpendicular orientation from the primary or top perimeter edge. Elongated orifices or openings of such character as illustrated in FIG. 3 are particularly beneficial when relatively wider band material 10 is employed.

Figure 4:
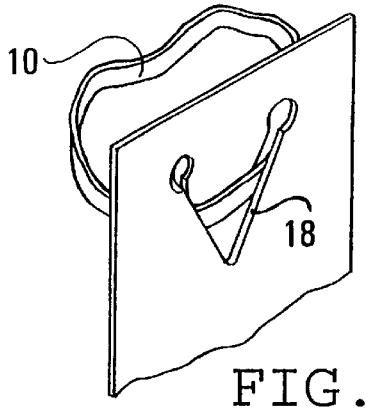
FIG. 4 is another schematic perspective view of the new marking tag, partially broken away, illustrating the bluntly pointed tongue in displaced condition by a band material occupying an intermediate portion of the slit between the tip and the base of the tongue.
Figure 5:
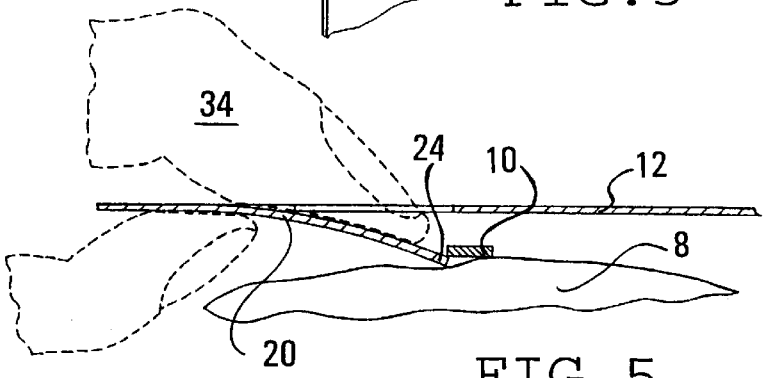
FIG. 5 is a schematic illustration of a side view of the new tag and illustrates displacement of the tongue member by finger pressure as the tongue member is inserted underneath a band (i.e., between a band and an item of merchandise about which the band extends)

In FIG. 5, a finger 34 is used to deflect the tongue from the exterior remaining body 12 of the new marking tag. At least the bluntly pointed tip 24 is so deflected and then slid beneath the band 10 about banded merchandise 8. All it takes is the start of the bluntly pointed tip underneath the band, and from that point the tag is easily moved against the band (as illustrated in FIG. 4) so as to slide the tongue fully under the band. Sliding the tongue fully under the band causes the band to be seated in the pair of openings 13, 14. At the point of seating, the band extends through the openings 13 and 14 and across the base 22 of the tongue 20. Releasing the tongue from deflection is suitably accomplished promptly after the apex or bluntly pointed tip of the tongue is placed under the band during the time the tongue is being slid beneath the band. In any event, at one point in the method of affixing the tag about a clump of merchandise, the finger deflection is released so as to permit the tongue to relax and return to a substantially nondeflected condition from the main body 12 of the tag.

The act of fixing the tag on a band is easily accomplished using one hand. Finger deflection of the tip of the tongue is accomplished using one's forefinger while holding the lateral edges of the tag body between one's thumb and the remaining fingers (other than the forefinger) of the hand.

The extraordinary simplicity of the new marking tag is deceptive. The perimeter and also the openings and the cut line between the openings are all easily die cut, although preferably not all at once. The extreme simplicity fails to reveal the true performance of the tag as an effective and highly attractive marker. Its symmetry is a contributing factor to its effectiveness. A line extending from the blunt tip to the midpoint between the orifices or openings reveals that the critical features in the new tag are a mirror image to each other.

The printed markings or indicia for the tag can vary but will generally include scannable bar codes for product identification such as those commonly called Universal Product Codes (UPC—a combination of bar code and numbers for product identification and usually also a price specification) and Product Look-Up numbers (PLU numbers). In the case of agricultural produce, the printed marking will generally also include recipes, nutritional information, serving suggestions, storage directions, origin of product information (such as produced in the U.S.A.), and everything else that could possibly help a consumer in making a purchasing decision and help retailers at check-out counters and in monitoring inventory.

Any of a variety of commercially available inks compatible and accepted on the sheet to be printed may be employed, and water-insoluble properties as well as adherence properties may be gained by any of a multitude of known commercial techniques readily understood in the art.

The entire body of the sheet material forming the tag may be of uniform character. It should be resilient in that it must be capable of some deflection at the tongue area in the process of getting it attached to a band but yet should be somewhat or relatively firm (i.e., stiff) and resiliently return to a relatively non-deflected position once the tongue is pushed under a band. Polystyrene is rather ideal but tag bodies of other plastics (or laminates of different materials including plastics) may be employed. The sheet material of the tag should be water resistant since tags on banded produce are frequently exposed to water sprays in supermarkets; and water washing of tagged produce is also a common practice. The varied materials useful for the sheet material of the marking tag include polyolefinic thermoplastics, polyesters, as well as still other plastics. Printable sheet material is needed, and this may be accomplished by applying special surface treatments as desired and well known in the industry. Printable plastic sheets may include laminates containing paper. A preferred plastic sheet comprises a polystyrene sheet called "Tear-Tuf" available from Pace Industries.

The openings are capable of accommodating varied popular sizes of rubber or elastomeric bands employed for banding merchandise, and particularly the wider bands so employed. Broccoli is a product for which the wider bands of ¼ inch or even ½ inch may be needed or highly useful. The cross-section size for bands for merchandise is rarely smaller than about 1/32 inch in perpendicular directions and frequently will be at least 1/16 inch in perpendicular directions. Bands greater than ⅛ inch in the smallest perpendicular direction may be used but generally are unnecessarily strong and needlessly expensive to employ for the banding of many items of merchandise. The size of the most useful rubber bands dictates that the ideal openings in the tag should not have a smaller dimension than about ⅛ inch (approximately 0.32 cm). Their smallest dimension should be at least ⅛ inch up to about ¼ inch (approximately 0.7 cm). The largest dimension for an orifice or opening may be about two or possibly even three times the smallest dimension. The edges of the openings should be curved, and circular or oval-type openings are the most practical and easiest to form by die cutting. They are beneficial in that they have no corners for the easy start of a tear. The openings preferably are always of a size that does not constrict or squeeze the band about merchandise.

The perimeter size for the new marking tag, in terms of total face area of the marking tag, will rarely be less than approximately 2 square inches or approximately 12.5 square centimeters. Useful tags will rarely have a face area in excess of 15 square inches and generally will not exceed a face area of about 12 square inches. The width between openings ideally does not exceed about an inch, and the total width for the most practical tags of the invention is not in excess of about 3 inches. Most ideally, the width for the tags on produce will not exceed about 2 inches, for this contributes to the retention of the tag on the produce as the banded produce with tags appended to the same is tossed about in a bin for marketing the same, and also contributes to the ease of handling a banded clump of produce for scanning purposes using only one hand.

The slit 18 extending between and connecting the openings is formed by a die cut that does not remove body material from the sheet. It is a die cut along a line as illustrated in the drawings. By not removing body material from the sheet, one maintains the maximum closure effect for the slit after it is affixed to a band about merchandise.

Those skilled in the art will readily recognize that this invention may be embodied in still other specific forms than illustrated without departing from the spirit or essential characteristics of it. The illustrated embodiment is therefore to be considered illustrative and not restrictive, the scope of the invention being indicated by the appended claims rather than the foregoing description; and all variations that come within the meaning and range of equivalency of the claims are intended to be embraced thereby.

That which is claimed is:

1. A marking tag adapted for affixing to a band about banded merchandise, said tag consisting of a resilient flat sheet body of plastic material having opposing planar surfaces at least one of which carries printed matter including a scannable bar code, said tag having an outer perimeter defining the outer limits of said sheet body, said outer perimeter including an upper edge, said flat sheet body being characterized by the following features all entirely within the outer perimeter of said body:

(i) a single pair of openings extending through said body and formed by removal of material from said sheet body, said openings being elongated and having a transverse dimension of at least ⅛ inch and a length dimension at least about two times longer than their transverse dimension and thus capable of readily receiving therein any of a variety of rubber bands of varied widths about banded merchandise, said openings being in a spaced relationship to each other not over about an inch and having their length dimension extending in a direction substantially perpendicular to said upper edge so that said elongated openings are in side-by-side parallel orientation to each other, said elongated openings being substantially equally spaced from said upper edge of said body, each said elongated opening having an outer edge nearest said upper edge and an inner edge furthest from said upper edge, (ii) a single die-cut slit extending through said body, said die-cut slit being such that it does not remove body material from said sheet and thus permits maximum resilient closure effect for the slit after said tag is affixed to a band about banded merchandise, said slit being such as to connect said pair of openings by extending from the inner edge of each said opening and forming a single resilient bluntly pointed tongue in said flat sheet body, said tongue having a base defined by the portion of said body directly between said pair of openings and said tongue having opposing sides and a bluntly pointed tip defined by said slit, said slit including a straight portion of at least a centimeter in length along each said opposing side of said tongue, said straight portions of said opposing sides being in an angular relationship of at least about 50 degrees and less than about 65 degrees such that said opposing sides converge toward each other and are conjoined at said bluntly pointed tip, and (iii) said bluntly pointed tongue being adapted for easy temporary deflection from the plane of said body by finger pressure to readily insert said bluntly pointed tip of said tongue underneath a band about banded merchandise and slide said tongue fully under such a band so as to seat such a band in said pair of openings of said tag so that the band will extend solely over said base of said tongue and allow said tongue and the remaining body of said tag to resiliently return to a relaxed condition closing said slit and putting said tongue in resting condition against the remaining flat body of said tag and thus maintain said tag in a substantially flush scannable condition against the banded merchandise.

2. The tag of claim 1 wherein said straight portions of said tongue extend directly from said inner edge of each said opening to said bluntly pointed tip.

3. The tag of claim 1 in combination with merchandise having a rubber band thereabout, wherein the rubber band about the merchandise extends through said tag openings and solely across the base of said tongue to hold said tag in substantially flush condition against the banded merchandise.

4. The tag of claim 1 wherein the distance between said pair of openings and the distance from each opening of said pair to said bluntly pointed tip of said tongue are all substantially equal.

5. A method of affixing a marking tag to the band about banded merchandise, wherein said marking tag consists of a resilient sheet body of plastic material having opposing planar surfaces at least one of which carries printed matter including a scannable bar code, said tag having an outer perimeter defining the outer limits of said sheet body, said outer perimeter including an upper edge, said flat sheet body being characterized by the following features all entirely within the outer perimeter of said body:

(a) a single pair of openings extending through said body and formed by removal of material from said sheet body, said openings being elongated and having a transverse dimension of at least ⅛ inch and a length dimension at least about two times longer than their transverse dimension and thus capable of readily receiving therein any of a variety of rubber bands of varied widths about banded merchandise, said openings being in a spaced relationship to each other not over about an inch and having their length dimension extending in a direction substantially perpendicular to said upper edge so that said elongated openings are in side-by-side parallel orientation to each other, said elongated openings being substantially equally spaced from said upper edge of said body, each said elongated opening having an outer edge nearest said upper edge and an inner edge furthest from said upper edge, (b) a single die-cut slit extending through said body, said slit being formed such that it does not remove body material from said sheet body and thus permits maximum resilient closure effect for the slit after said tag is affixed to a band about banded merchandise, said slit being such as to connect said pair of openings by extending from the inner edge of each said opening and forming a single resilient bluntly pointed tongue in said flat sheet body, said tongue having a base defined by the portion or said body directly between said pair of openings and said tongue having opposing sides and a bluntly pointed tip defined by said slit, said slit including a straight portion of at least a centimeter in length along each said opposing side of said tongue, said straight portions of said opposing sides being in an angular relationship greater than 40 degrees and less than about 65 degrees such that said opposing sides converge toward each other and are conjoined at said bluntly pointed tip, and (c) said bluntly pointed tongue being adapted for easy temporary deflection from the plane of said body by finger pressure to readily insert said bluntly pointed tip of said tongue underneath a band about banded merchandise and slide said tongue fully under such a band so as to seat such a band in said pair of openings of said tag so that the band will extend solely over said base of said tongue and allow said tongue and the remaining body of said tag to resiliently return to a relaxed condition closing said slit and putting said tongue in resting condition against the remaining flat body of said tag and thus maintain said tag in a substantially flush scannable condition against the banded merchandise, said method comprising (i) deflecting said tongue from the plane of the remainder of said resilient flat sheet body by finger pressure, (ii) inserting the blunt tip of said tongue underneath the band about said banded merchandise, (iii) sliding said tongue fully under said band so as to seat said band in said pair of openings of said tag with said band extending through said openings and solely across the base of said tongue, and (iv) releasing said tongue from deflection to permit it and the remaining body of said tag to resiliently return to a relaxed condition closing said slit and putting said tongue in resting condition against the remaining body of said tag and thus maintain said tag in a substantially flush scannable condition against the banded merchandise.

6. A method of tagging banded merchandise comprising the steps of:

(i) providing a tag consisting of a resilient flat sheet body of plastic material having opposing planar surfaces, at least one of said surfaces having produce information printed thereupon including a scannable bar code, said tag having an outer perimeter defining the outer limits of said sheet body, said perimeter including an upper edge, (ii) making a single pair of openings in said body by removal of material from said sheet body to make said openings, said openings being at least ⅛ inch in their smallest dimension and adapted to receive a band about banded merchandise, said openings being in spaced relationship to each other not over about an inch and substantially equally spaced from said upper edge of said body, ease said opening having an outer edge nearest said upper edge and an inner edge furthest from said upper edge, said openings being entirely within said outer perimeter of said resilient flat sheet body, (iii) forming a single slit through said body by a die cut that does not remove material from said body and thus permits maximum resilient closure effect for the slit after said tag is affixed to a band about banded merchandise, said slit being such as to connect said pair of openings by extending from the inner edge of each said opening, said slit being such as to form a resilient bluntly pointed tongue in said body, said tongue having a base defined by the portion of said body directly between said pair of openings and said tongue having opposing sides and a bluntly pointed tip defined by said slit, said slit including a straight portion of at least a centimeter in length along each said opposing side of said tongue, said straight portions so said opposing sides being in an angular relationship greater than 40 degrees and less than about 65 degrees such that said opposing sides converge toward each other and are conjoined at said bluntly pointed tip, said slit being entirely within said outer perimeter of said resilient flat sheet body, (iv) applying finger pressure to deflect said bluntly pointed tip of said tongue from the portion of said resilient flat sheet body exterior to said tongue, (v) inserting said deflected bluntly pointed tip of said tongue underneath a band about banded merchandise, (vi) sliding said tongue fully under said band so as to seat said band in said pair of openings of said body with said band extending through said openings and solely across the base of said tongue, and (vii) releasing said tongue from deflection to permit is and the remaining body of said tag to resiliently return to a relaxed condition closing said slit and putting said tongue in resting condition against the remaining body of said tag and thus maintain said tag in a substantially flush scannable condition against the banded merchandise.

7. A marking tag adapted for affixing to a band about banded merchandise, said tag consisting of a resilient flat sheet body of plastic material having opposing planar surfaces at least one of which carries printed matter including a scannable bar code, said tag having an outer perimeter defining the outer limits of said sheet body, said outer perimeter including an upper edge, said slat sheet body being characterized by the following features all entirely within the outer perimeter of said body:

(i) a single pair of openings extending through said body and formed by removal of material from said sheet body, said openings being elongated and having a transverse dimension of at least ⅛ inch and a length dimension at least about two times longer than their transverse dimension and thus capable of readily receiving therein any of a variety of rubber bands of varied widths about banded merchandise, said openings being in a spaced relationship to each other and having their length dimension extending in a direction substantially perpendicular to said upper edge so that said elongated openings are in side-by-side parallel orientation to each other, said elongated openings being substantially equally spaced from said upper edge of said body, each said elongated opening having an outer edge nearest said upper edge and an inner edge furthest from said upper edge, (ii) a single die-cut slit extending through said body, said die-cut slit being such that it does not remove body material from said sheet and thus permits maximum resilient closure effect for the slit after said tag is affixed to a band about banded merchandise, said slit being such as to connect said pair of openings by extending from the inner edge of each said opening and forming a single resilient bluntly pointed tongue in said flat sheet body, said tongue having a base defined by the portion of said body directly between said pair of openings and said tongue having opposing sides and a bluntly pointed tip defined by said slit, said slit including a straight portion of at least a centimeter in length along each said opposing side of said tongue, said straight portions of said opposing sides being in an angular relationship greater than 40 degrees and less than about 65 degrees such that said opposing sides converge toward each other and are conjoined at said bluntly pointed tip, said slit being such that it extends laterally outward from each said opening in a manner substantially tangential to said inner edge of each said opening and then curves to form said straight portions, and (iii) said bluntly pointed tongue being adapted for easy temporary deflection from the plane of said body by finger pressure to readily insert said bluntly pointed tip of said tongue underneath a band about banded merchandise and slide said tongue fully under such a band so as to seat such a band in said pair of openings of said tag so that the band will extend solely over said base of said tongue and allow said tongue and the remaining body of said tag to resiliently return to a relaxed condition closing said slit and putting said tongue in resting condition against the remaining flat body of said tag and thus maintain said tag in a substantially flush scannable condition against the banded merchandise.

8. The tag of claim 7 wherein the angular relationship of the straight portions of said opposing sides is at least about 50 degrees.

9. The marking tag of claim 8 wherein the spaced relationship of said openings to each other is not over about an inch.

10. The marking tag of claim 7 wherein the spaced relationship of said openings to each other is not over about an inch.

11. A marking tag adapted for affixing to a band about banded merchandise, said tag consisting of a resilient flat sheet body of plastic material having opposing planar surfaces at least one of which carries printed matter including a scannable bar code, said tag having an outer perimeter defining the outer limits of said sheet body, said outer perimeter including an upper edge, said flat sheet body being characterized by the following features all entirely within the outer perimeter of said body:

(i) a single pair of openings extending through said body and formed by removal of material from said sheet body, said openings being elongated and having a transverse dimension of at least ⅛ inch and a length dimension at least about two times longer than their transverse dimension and thus capable of readily receiving therein any of a variety of rubber bands of varied widths about banded merchandise, said openings being in a spaced relationship to each other and having their length dimension extending in a direction substantially perpendicular to said upper edge so that said elongated openings are in side-by-side parallel orientation to each other, said elongated openings being substantially equally spaced from said upper edge of said body, each said elongated opening having an outer edge nearest said upper edge and an inner edge furthest from said upper edge, (ii) a single die-cut slit extending through said body, said die-cut slit being such that it does not remove body material from said sheet and thus permits maximum resilient closure effect for the slit after said tag is affixed to a band about banded merchandise, said slit being such as to connect said pair of openings by extending from the inner edge of each said opening and forming a single resilient bluntly pointed tongue in said flat sheet body, said tongue hanging a base defined by the portion of said body directly between said pair of openings and said tongue having opposing sides and a bluntly pointed tip defined by said slit, said slit including a straight portion of at least a centimeter in length along each said opposing side of said tongue, said straight portions of said opposing sides being in an angular relationship greater than 40 degrees and less than about 65 degrees such that said opposing sides converge toward each other and are conjoined at said bluntly pointed tip, said slit being such that it extends laterally outward in an oblique direction from each said opening inner edge toward said outer perimeter upper edge and then curves to form said straight portions of said opposing sides, and (iii) said bluntly pointed tongue being adapted for easy temporary deflection from the plane of said body by finger pressure to readily insert said bluntly pointed tip of said tongue underneath a band about banded merchandise and slide said tongue fully under such a band so as to seat such a band in said pair of openings of said tag so that the band will extend solely over said base of said tongue and allow said tongue and the remaining body of said tag to resiliently return to a relaxed condition closing said slit and putting said tongue in resting condition against the remaining flat body of said tag and thus maintain said tag in a substantially flush scannable condition against the banded merchandise.

12. The marking tag of claim 11 wherein the spaced relationship of said openings to each other is not over about an inch.

* * * * *